United States Patent [19]

Merz

[11] Patent Number: 4,709,666

[45] Date of Patent: Dec. 1, 1987

[54] REGULATABLE FAN DRIVE

[75] Inventor: Johann Merz, Schwabisch Gmund, Fed. Rep. of Germany

[73] Assignee: Zahnradfabrik Friedrichshafen, Ag., Friedrichshafen, Fed. Rep. of Germany

[21] Appl. No.: 836,982

[22] Filed: Mar. 6, 1986

[30] Foreign Application Priority Data

Mar. 14, 1985 [WO] PCT Int'l Appl. ..... PCT/EP85/00104

[51] Int. Cl.[4] ..... F01P 5/04

[52] U.S. Cl. ..... 123/41.12; 123/41.49; 137/625.47

[58] Field of Search ..... 127/41.12, 41.49; 137/625.41, 625.47

[56] References Cited

U.S. PATENT DOCUMENTS 4,377,989 3/1983 Tholen et al. ..... 123/41.49
4,446,697 5/1984 Goscenski, Jr. ..... 123/41.12
4,479,532 10/1984 Watanabe ..... 123/41.49
4,487,255 12/1984 Bianchetta et al. ..... 123/41.12

FOREIGN PATENT DOCUMENTS 13119 1/1983 Japan ..... 123/41.49

*Primary Examiner*—William A. Cuchlinski, Jr.
*Attorney, Agent, or Firm*—Zalkind & Shuster

[57] ABSTRACT

A regulatable drive for speed control of the cooling fan of an internal combustion engine comprises fluid feed from a tank to the suction side of a pump via a suction passage wherein flow is controlled by a regulatable multi-position valve. The pump provides pressure feed to the suction side of a fluid motor that operates the fan. A bypass passage connects the suction passage of the fluid pump through the regulatable valve to the suction side of the fluid motor. The regulatable valve is actuated for control of suction feed to the pump responsive to fan speed via control circuitry which may also be responsive to engine temperature.

14 Claims, 3 Drawing Figures

REGULATABLE FAN DRIVE

BACKGOUND OF THE INVENTION

It is common practice to drive a cooling fan via V-belt directly from the crank shaft of an internal combustion engine. In such arrangements, the fan runs continuously even where a coupling has been interposed for some regulation.

Such systems have the disadvantage that at times fan cooling is not desirable, e.g., in starting an engine in cold weather. Also, a continuously driven fan consumes energy needlessly.

There are prior art systems wherein cooling fans are driven by electric motors which provide operation when needed. However, the use of electric motors increases expense and complexity.

Further, cooling fans have heretofore been hydraulically driven wherein a valve is used downstream of a pump to bypass pump output flow to pump intake. However, such pumps are in constant operation causing energy loss in the sense that fluid is constantly flowing in from outlet to inlet in substantially full flow even when the fan is not operating.

Also, while the present invention uses a method of control of suction feed to the pump, the basic system of suction feed control or regulation is not new. However, even with complete regulation the pump cannot be brought to a complete standstill due to required interior lubrication and oil leakage. Thus, the fluid motor would still receive pressure feed and the cooling fan would continue to rotate.

BRIEF DESCRIPTION OF THE INVENTION

In the present invention, a minimumization of energy loss is effected by regulating the suction feed to the pump by means of a bypass connection from pump outlet through a regulating valve which is controlled responsive to fan speed. This controls bypass flow from pump outlet to pump inlet. Accordingly, when the fan is not operating only minimal flow passes through the pump.

In the bypass arrangement circuit there is a return line for bypass flow to the regulating valve. When actuated, this valve opens or closes flow from the pressure side to the suction side of the pump. When open, the bypass flow effects minimum pump operation, i.e., zero position. The flow quantity is small and consumes negligible energy. Instead of connection from the regulating valve to the pump intake passage, the bypassed fluid may go to the tank.

The regulating valve can be of simple construction having a rotative valve member with flow control means coacting with ports or bores in a tubular housing, for bypass flow control.

A simple mode of providing for flow passage in the rotary valve is to transversely slot the periphery of the rotary body so that it has edge means which can coact for cut-off with a radial bore through the housing wall.

Also, but cutting a slant on the end of the rotative valve member, an end surface is provided which in rotated positions can close or open a bore in the housing. Other details of the regulating valve will be made clear subsequently.

A detailed description of the invention now follows in conjunction with the appended drawing, in which.

Figure 1:
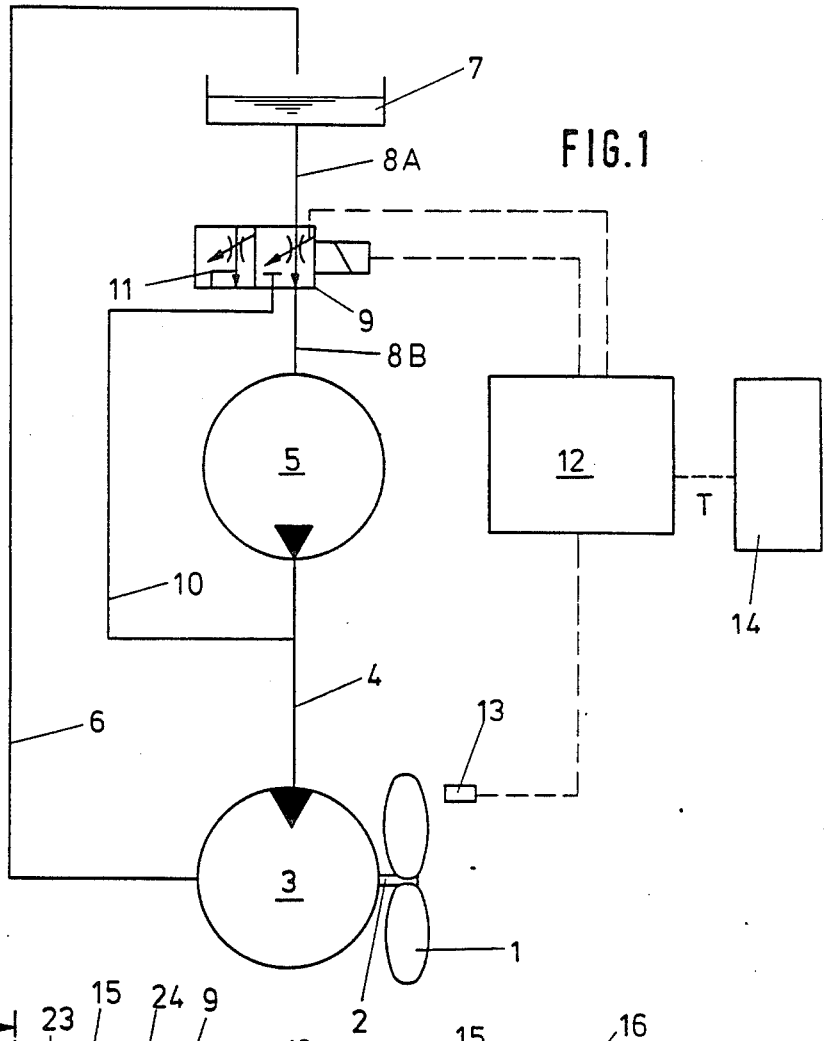
FIG. 1 is a symbolic hydraulic diagram of the regulatable valve means and electronic control.

Referring to FIG. 1, a fan 1 has a fan shaft 2 driven by fluid motor 3. The motor 3 may be of any known construction, although a piston motor is well suited. The motor 3 is supplied with pressure feed, generally oil, by a pump 5 via a pressure line 4. The motor exhaust returns via a return line 6 to a tank 7, from where it is again fed to the suction side of the pump 5 via suction lines 8A and 8B through a regulatable i.e., regulating valve 9. Thus, pump 5 is selected as a piston pump and feeds pressure oil via the pressure line 4 to the motor 3, as a result of which the fan 1 is driven at a speed dependent on the pressure and quantity feed of intake to the motor.

Regulating valve 9 is constructed as a rotary valve, the structure of which will be explained subsequently in more detail on the basis of FIGS. 2 and 3.

In the position shown in FIG. 1, the regulating valve is in the open flow position, whereby fan operational flow to the pump is effected. For minimal flow the valve in FIG. 1 shifts to the right. In this case, a bypass return line 10, which connects to the pressure feed line 4 downstream of the pump 5, is connected via a flow control passage 11 (also see FIG. 2), with the pump suction line 8A to the tank. Thus, in zero position of the pump, i.e., in idling conveyance, the outlet flow of the pump 5 is carried by line 10. The motor 3 is then no longer supplied with pressure feed and the fan is at a standstill.

For precise rpm regulation of the fan 1, a regulating electronic system 12 is utilized, the signals from which control the regulating valve 9 correspondingly. The values required for regulation are determined by an rpm sensor 13, which measures the rmp of the fan 1 and by a temperature measuring device/$^{T}$on the combustion motor 14.

Naturally, the invention is not limited to the regulation of a fan for a combustion motor; rather any fan may be regulated within the teaching of the invention, which is to be controlled from standstill up to maximum rpm.

Figure 2:
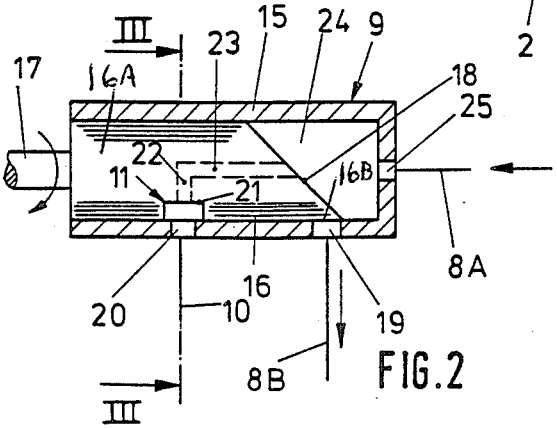
FIG. 2 is a longitudinal section of a regulating valve.
Figure 3:
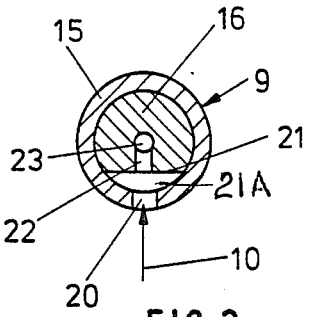
FIG. 3 is a section on the line III—III of FIG. 2.

The construction of a regulating valve 9, per se, will be understood from FIGS. 2 and 3.

A physical embodiment of a regulating valve 9 has a cylindrical housing 15, in which is a rotary valve 16 comprising a cylindrical body member 16A. The rotary valve 16 can be rotated by a shaft 17. The forward end of the rotary valve 16 has a slanting surface 18, which affords a circumferential surface 16B that, depending on rotated position, opens or closes an outlet bore 19 in the wall of housing 15, shown closed in FIG. 2. An inlet opening 25 connects with the suction line 8A, while the outlet opening 19 connects with the suction line 8B leading to the pump 5.

The flow channel 11, which is a chordal channel 21A in the valve body (FIG. 3) connects the return line 10 with the suction line 8A or 8B and carries flow through regulating valve 9. There is a return bore 20 in the housing 15, which cooperates with flow control edge 21 of the chordal channel in the rotary valve 16. The edge 21 may be effected in a simple manner by transverse milling of the peripheral wall of the rotary valve 16 to form the chordal channel. Connecting to channel 21A is a radial bore 22 to the longitudinal axis of the rotary valve 16, connecting to a longitudinal bore 23 extending through the slanted surface 18. Thus, FIGS. 2 and 3 show the flow connections between the return line 10 and a chamber 24 for flow through regulating valve 9. As shown in FIG. 2, the outlet opening 19 appears closed, by leakage oil flows nevertheless through the suction line 8B to the pump 5 to be conveyed back via the return line 10.

Thus, valve 9 is so regulated that leakage oil is recirculated for pump lubrication, but such flow is not effective to overcome the friction and inertia of the fluid motor which remains motionless so that the fan is stationary, although the pump is operationally idling to be continuously lubricated.

For the operation of the fan 1, it will merely be necessary to operate the control shaft 17 of the rotary valve 16 correspondingly. During rotation of the shaft 17, and as shown by the arrow in FIG. 2, rotary valve 16 rotates to uncover, i.e., to open the outlet bore 19, while simultaneously edge 21 rotates to close the return bore 20. Accordingly, bypass flow is cut off from bores 22 and 23. Lines 8A and 8B provide feed flow to the pump from the tank. Thus, speed regulation of the fan 1 takes place continuously, with e.g., electromagnetic or any other electrical means effecting rotation response to signals from the electronic control circuitry.

I claim:

1. A regulatable drive for the cooling fan (1) of an internal combustion engine/[14]comprising a tank (7) for holding a fluid, a pump (5) and a fluid motor (3) in sequential connection whereby fluid from said tank is pumped to said fluid motor for driving said fan, said pump having a suction side connecting to said tank and said fluid motor having a suction side connecting to the pressure outlet of said pump;

the improvement which comprises:

pump suction passage means (8A, 8B) from said tank to the suction side of said pump, and a regulatable valve means (9) in said pump suction passage means;

a fluid motor suction passage means (4) from the pressure outlet of said pump to the suction side of said fluid motor;

a bypass passage (10) connecting said latter passage means (4) to said regulatable valve means (9);

said regulatable valve means comprising movable control means (16) movable from a position to effect flow from said tank to the suction side of said pump and thence to said fluid motor to drive said fan, and in another position to bypass flow through said bypass passage from the pressure outlet of said pump to therethrough via said regulatable valve means to regulate fan speed.

2. A regulatable drive as set forth in claim 1, said regulatable valve means having a housing (15) for said movable control means and said pump suction passage means (8A, 8B) comprising a tank port (25) in said housing connecting to said tank and said housing also having a pump suction port (19) for flow to the suction side of said pump and having a bypass port (20) connecting to said bypass passage;

said movable control means (16) comprising a control passage (11) shiftable by movement of said movable control means to one position for opening flow from said bypass passage to said bypass port for recirculation through said pump or to close said flow in another position while opening flow from said tank port to said pump suction port;

said movable control means having passage means (22, 23) connecting between said control passage (11) and said tank port.

3. A regulatable drive as set forth in claim 2, said control passage having a bypass flow control edge (21) movable across said bypass port for flow control therethrough.

4. A regulatable drive as set forth in claim 3, said movable control means (16) comprising a control member (16A) having a pump suction control surface (16B) movable relative said pump suction port to open or close pump suction flow;

said control edges (16B, 21) being disposed on said movable control member so that either control edge is positioned for closed flow when the other is positioned for open flow.

5. In a regulatable drive as set forth in claim 4, said control member (16A) being cylindrical and adjustably rotative in said housing and wherein said control passage (11) is a chordal channel (21A) in said control member and said bypass flow control edge (21) is an end of said chordal channel coacting with said bypass port (20) for control of flow therethrough;

said control member (16A) having a truncated end (18) effecting a chamber (24) within said housing for fluid ingress from said tank port (25);

said control member (16A) having passage means (22, 23) connecting from said control passage (11) to said chamber (24).

6. In a regulatable drive as set forth in claim 5, including fan speed responsive means (13) coupled to said regulatable valve means for adjustably rotating said control member (16A) to control suction flow to said pump.

7. In a regulatable drive as set forth in claim 6, including temperature responsive means coupled to said regulatable valve means to adjustably rotate said control member in coaction with said speed responsive means.

8. In a regulatable drive as set forth in claim 5, including temperature responsive means (T) coupled to said valve means regulatable to adjustably rotate said control member for suction flow control to said pump.

9. In a regulatable drive as set forth in claim 1, said pump being a piston pump.

10. A regulatable drive for the cooling fan of an internal combustion engine as set forth in claim 1, said regulatable valve means (9) being movable to a position to cut off effective operating pressure flow to said fluid motor whereby said fan is motionless; and wherein when said valve means is in said cut off position a leakage therethrough due to incomplete closure permits recirculation sufficient to maintain lubrication of said pump.

11. A method of regulating the speed of a cooling fan for an internal combustion engine wherein said fan is driven by a fluid motor in turn driven by a pump, which method comprises regulating suction feed to said pump responsive to fan speed so that suction feed is always sufficient to effect lubrication of said pump but during pump idling is insufficient to effect pressure to operate said fluid motor.

12. A method as set forth in claim 11, which method also includes responsiveness to temperature of said internal combustion engine.

13. A method as set forth in claim 12, wherein said pump is a constant stroke piston pump.

14. A method of regulating speed of a cooling fan for an internal combustion engine, wherein said fan is driven by a fluid motor driven by a pump, which method comprises regulating suction feed to said pump responsive to temperature of said internal combustion engine so that suction feed is always sufficient to effect lubrication of said pump but during pump idling is insufficient to effect pressure to operate said fluid motor.

* * * * *